US006732991B1

(12) United States Patent
Zakrzewski et al.

(10) Patent No.: US 6,732,991 B1
(45) Date of Patent: May 11, 2004

(54) ADAPTER FOR LIGHTING TRACK

(75) Inventors: Bogdan Zakrzewski, Bartlett, IL (US); Steven Pyshos, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/909,984

(22) Filed: Jul. 23, 2001

Related U.S. Application Data

(60) Provisional application No. 60/229,596, filed on Sep. 5, 2000.

(51) Int. Cl.[7] ..... A47H 1/10
(52) U.S. Cl. ..... 248/317
(58) Field of Search ..... 248/317, 228.1, 248/228.3, 227.2, 327

(56) References Cited

U.S. PATENT DOCUMENTS

| | | | | | |
|---|---|---|---|---|---|
| 2,291,490 | A | * | 7/1942 | Naysmith | 362/221 |
| 2,909,355 | A | * | 10/1959 | Nelson | 110/111 |
| 2,963,251 | A | * | 12/1960 | Fuss | 248/228.1 |
| 3,075,072 | A | * | 1/1963 | Gibson et al. | 362/219 |
| 3,123,310 | A | * | 3/1964 | Dameral | 362/221 |
| 3,364,348 | A | * | 1/1968 | Dameral | 362/221 |
| 4,109,305 | A | * | 8/1978 | Claussen et al. | 362/418 |
| 5,025,355 | A | * | 6/1991 | Harwood | 362/147 |
| 5,334,037 | A | * | 8/1994 | Gabrius et al. | 439/118 |
| 5,335,890 | A | * | 8/1994 | Pryor et al. | 16/94 D |
| 6,059,582 | A | * | 5/2000 | Tsai | 362/287 |
| 6,220,721 | B1 | * | 4/2001 | Chan et al. | 362/219 |
| 6,298,623 | B1 | * | 10/2001 | Wendt | 248/343 |
| D452,581 | S | * | 12/2001 | Zakrzewski et al. | D13/139.2 |
| 6,345,800 | B1 | * | 2/2002 | Herst et al. | 248/342 |
| 2002/0066847 | A1 | * | 6/2002 | Belknap | 248/544 |

OTHER PUBLICATIONS

Installation Instructions for L993 Pendant Kit Assembly, for use with HALO CAT L610 Series Raceway Track Systems Only, Cooper Lighting, #696400, 1 page, publication at least one year before the filing date of application.

Installation Instructions for L–954 Pendant Kit, for use with HALO L–620 Series Track System Only, Cooper Lighting, #696522, 1 page, publication at least one year before the filing date of application.

Installation Instructions for L–992 and L–951, use only with HALO L–640 & L–650 series track system only, Cooper Lighting, #698487, 1 page, publication at least one year before the filing date of application.

* cited by examiner

*Primary Examiner*—Leslie A. Braun
*Assistant Examiner*—A. Joseph Wujciak
(74) *Attorney, Agent, or Firm*—Thomas, Kayden, Horstemeyer & Risley LLP

(57) ABSTRACT

An adapter is used for installing a lighting track to a ceiling structure. The adapter is defined by a longitudinal axis. The lighting track has side walls that define a trough and ledges protruding into the trough. The adapter includes a first element, a first flange element, a second element, and a second flange element. The first element is designed to attach to a device that is secured to the ceiling structure. The first flange element is attached to the first element to engage at least one of the side walls and at least one of the ledges of the lighting track. The second element is attached to the first flange element and receivable within the ledges of the lighting track. The second flange element is attached to the second element to engage the ledges of the lighting track.

32 Claims, 11 Drawing Sheets

8

ADAPTER FOR LIGHTING TRACK

CROSS REFERENCE TO RELATED APPLICATIONS

This application claims benefit to U.S. Provisional Application No. 60/229,596, filed Sep. 5, 2000, which is incorporated by reference.

TECHNICAL FIELD

This invention relates to installation and suspension of lighting tracks.

BACKGROUND

Lighting tracks may be installed and suspended to a ceiling structure with a bracket that connects to a device such as a tube using several other connection devices. The tube then is connected to the ceiling structure using other connection devices. For example, to connect a tube to the bracket, a first nut may be threaded to the tube, and the tube and the first nut then may be fed through the bracket. Subsequently, a second nut may be threaded to the tube below the bracket to secure the bracket to the tube. The bracket then may be secured to the lighting track using additional screws such that the bracket engages the lighting track and couples the lighting track to the tube.

SUMMARY

In one general aspect, an adapter for installing a lighting track to a ceiling structure defines a longitudinal axis. The lighting track has side walls that define a trough and ledges protruding into the trough. The adapter includes a first element, a first flange element, a second element, and a second flange element. The first element is designed to attach to a device that is secured to the ceiling structure. The first flange element is attached to the first element to engage at least one of the side walls and at least one of the ledges of the lighting track. The second element is attached to the first flange element and receivable within the ledges of the lighting track. The second flange element is attached to the second element to engage the ledges of the lighting track.

Implementations may include one or more of the following features. For example, the first element may be cylindrical along the longitudinal axis. The first element may include threads that match threads of the device to facilitate attachment of the first element to the device. The first element also may include an opening through which the device is secured. The first element may include a ridge formed along an outer surface.

The first flange element may be defined by a plane having a normal parallel to the longitudinal axis. The first flange element may include a tab protruding from a side of the second flange element, with the tab being defined by a plane having a normal perpendicular to the longitudinal axis, and having a long side, a short side, and an angled side joining the short side to the long side. The angled side may be configured to engage at least one of the ledges and the long side may be configured to engage at least one of the side walls of the lighting track when the adapter is attached to the lighting track.

The second flange element may be designed to be receivable between the ledges of the lighting track. The second flange element may be defined by a plane having a normal parallel to the longitudinal axis. The second flange element may include four sides, two of which span a width less than a distance between the ledges of the lighting track and two of which span a width greater than the distance between the ledges of the lighting track.

In another general aspect, a lighting track is installed to a ceiling structure using an adapter. A lighting track is provided that has side walls, a bottom portion connecting the sidewalls to form a trough, and ledges extending into the trough from the side walls. An adapter is provided that is defined by a longitudinal axis, and has a first element, a first flange element, a second element, and a second flange element. The first flange element is attached to the first element and has a tab element. The second element is attached to the first flange element and the second flange element is attached to the second element. A device is connected to the first element. The second flange element is inserted into the trough such that the second element lines up with the ledges and the first flange element engages the side walls. Next, the adapter is rotated about the longitudinal axis such that the second flange element engages the ledges, and the tab element engages at least one of the ledges. The device then is connected to the ceiling structure.

Implementations may include one or more of the following features. For example, the adapter may be rotated until the tab element engages at least one of the side walls, until the tab element is positioned between the side walls to prevent the adapter from rotating about the longitudinal axis relative to the lighting track, and until the adapter is prevented from translating along the longitudinal axis relative to the lighting track.

The second flange element may be inserted into the trough beyond the ledges. The second flange element may be inserted into the trough by positioning the adapter such that the tab element is external to the trough.

Aspects of the techniques and systems provide many advantages. For example, the techniques and systems may eliminate the need to use multiple components to couple and secure the device to the lighting track, which eliminates the task of installing and assembling those multiple components.

Other features and advantages will be apparent from the description, the drawings, and the claims.

DESCRIPTION OF DRAWINGS

Like reference symbols in the various drawings indicate like elements.

DETAILED DESCRIPTION

Figure 1:
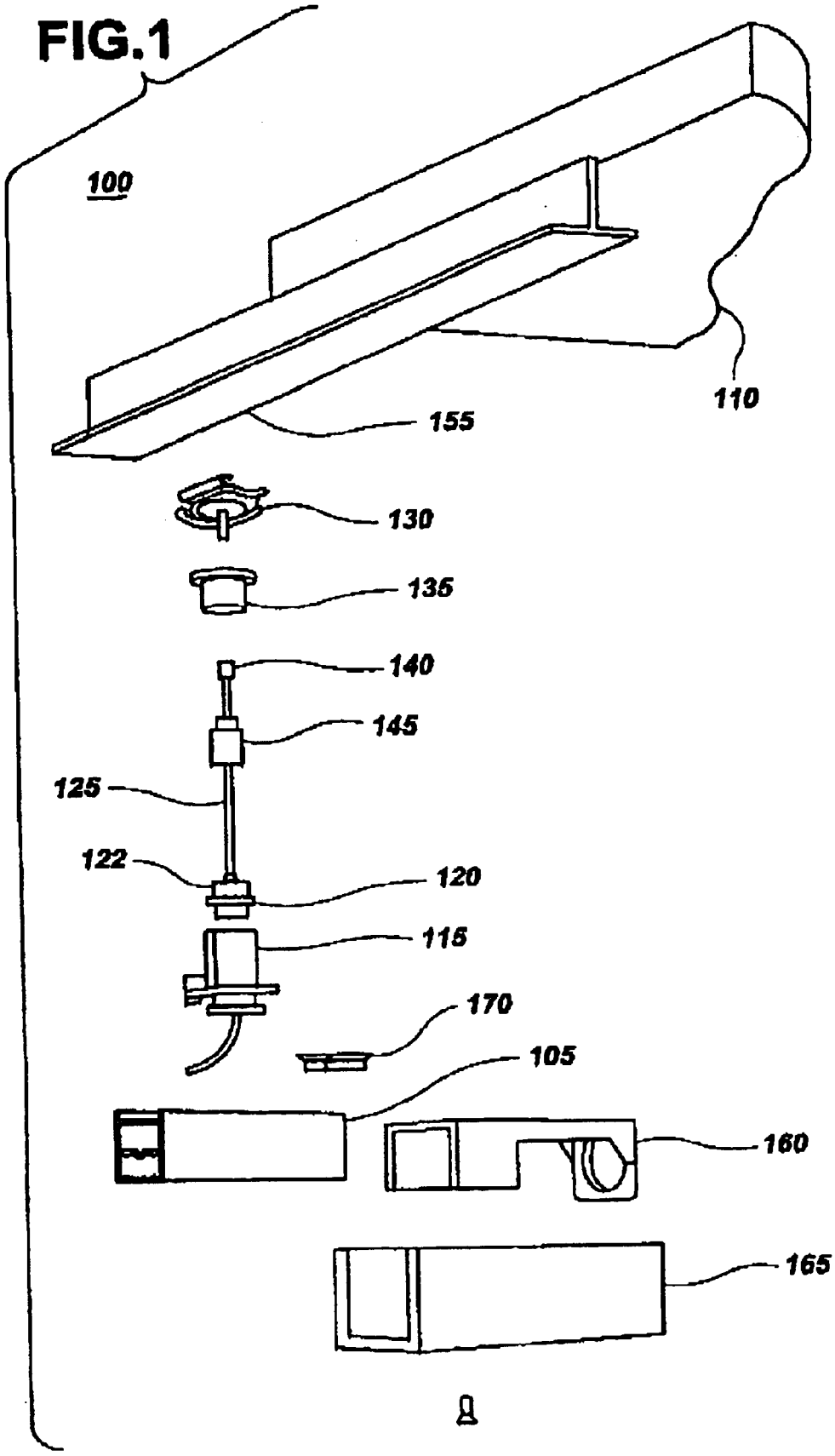
FIG. 1 is an exploded perspective view of a system for installing a lighting track.
Figure 2:
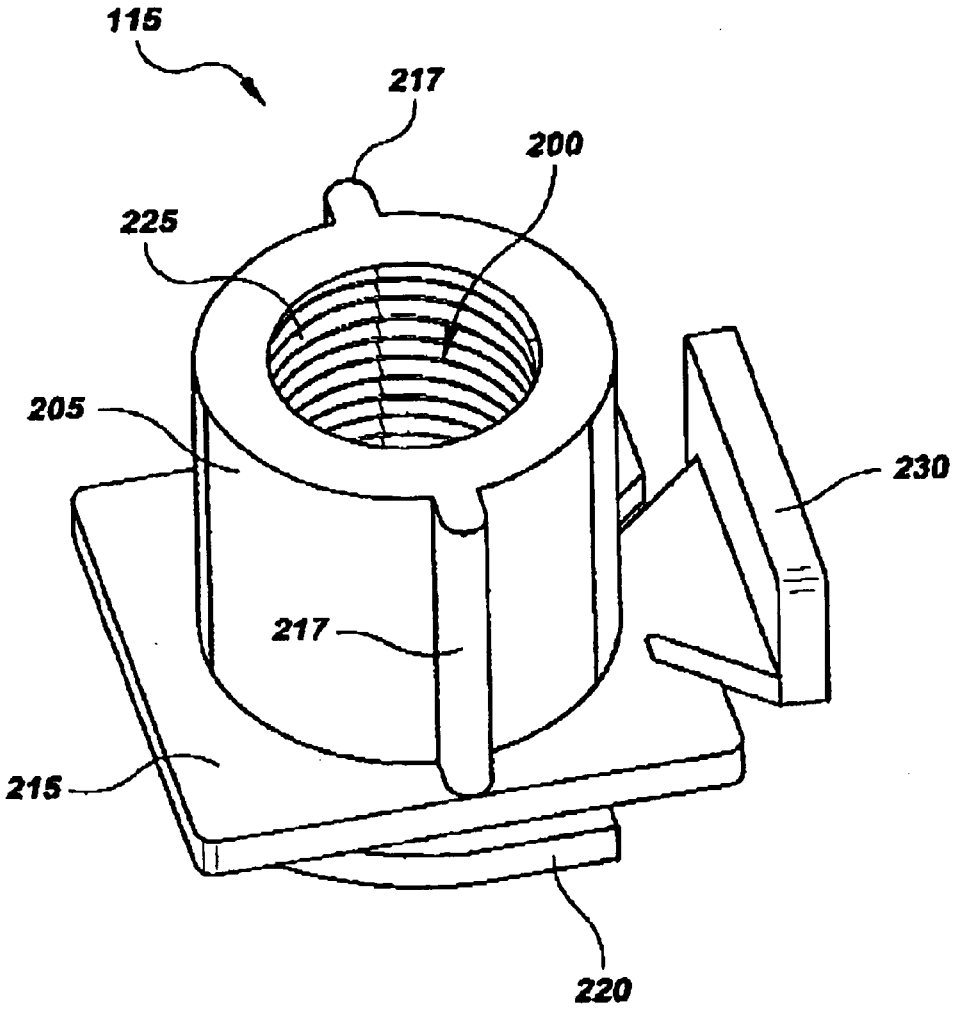
FIG. 2 is a top front perspective view of an adapter used in the installation system of FIG. 1.
Figure 3:
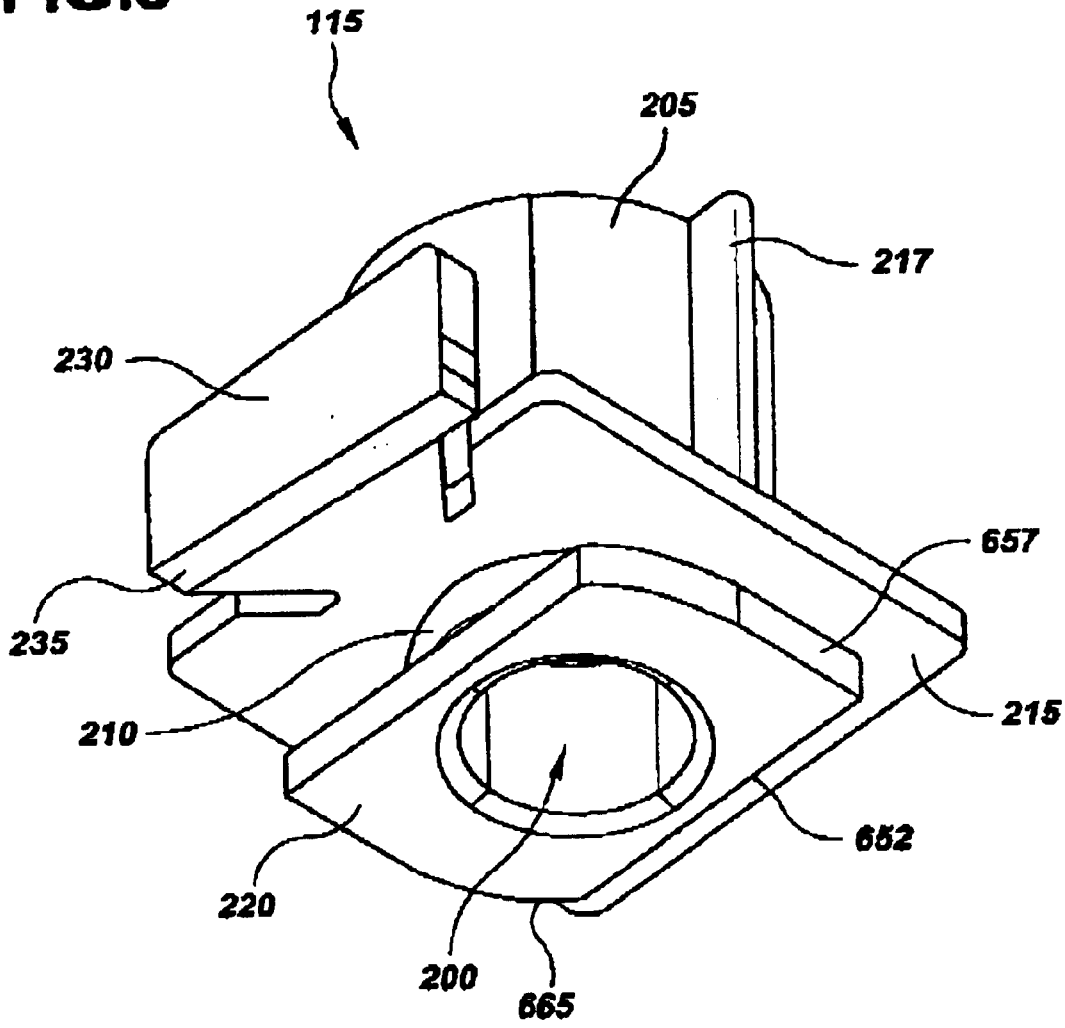
FIG. 3 is a bottom rear perspective view of the adapter of FIG. 2.

Referring to FIG. 1, a suspension system 100 is used to mount a lighting track 105 to a ceiling structure 110. The suspension system 100 includes an adapter 115 that engages the lighting track 105 during suspension. The adapter 115 couples the lighting track 105 to a device 120 that is secured or mounted through other suspension components to the ceiling structure 110.

In the one implementation of FIG. 1, the device 120 includes a cable coupler 122 that attaches to a cable 125. The suspension system 100 also may include a clip 130 that fastens a ceiling fitting 135, a crimp 140, a ceiling coupler 145, and the device 120 to a t-bar 155 coupled to the ceiling structure 110. Lights connected to the lighting track 105 receive power through a power source, such as a lighting power connector 160, which is protected by a cover 165. In another implementation, the device 120 includes a rigid tube that connects directly to the ceiling fitting 135.

The suspension system 100 may also include a retaining device 170 that snaps into the lighting track 105. The retaining device 170 may be custom cut to fit into the space between the adapter 115 and any connectors or feeds through the lighting track 105. In this way, the retaining device 170 may be used to prevent the adapter 115 fruit from moving along a longitudinal axis of the lighting track 105. The retaining device 170 may be made of any suitable material such as plastic or metal.

Referring also to FIGS. 2, 3, 4A, 4B, 5A, and 5B, the adapter 115 has a central opening 200 that defines a longitudinal axis 202. The opening 200 may pass through a portion of the adapter 115 or along the full length of the adapter 115. In general, the opening 200 may be used to receive and retain wires or other electrical devices used for operation of the lights mounted to the lighting track 105.

The opening 200 has an inner surface 225, at least a portion of which may be shaped for receiving the device 120. For example, the inner surface 225 may include a portion that is threaded to match threads on the device 120. The adapter 115 may be designed from a single piece of a rigid insulating material, such as, for example, plastic. Additionally, the adapter 115 may be formed using any suitable method, such as, for example, injection molding.

The adapter 115 includes a first element 205 (FIG. 2) and a second element 210 (FIG. 3) through which the central opening 200 passes. The first element 205 may include ridges 217 formed along an outer surface to facilitate rotation of the adapter 115 during installation. The first and second elements 205, 210 may be cylindrical.

Figure 4A:
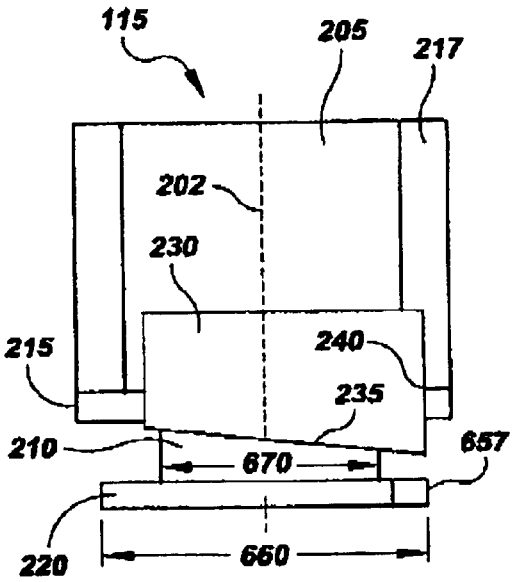
FIGS. 4A and 4B are side views of the adapter of FIG. 2.
Figure 4B:
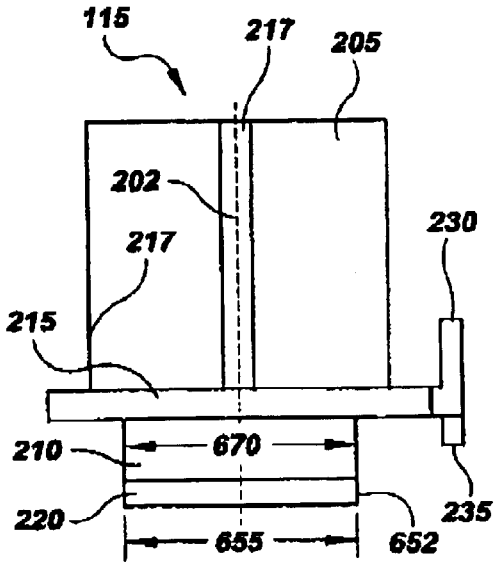
Figure 5A:
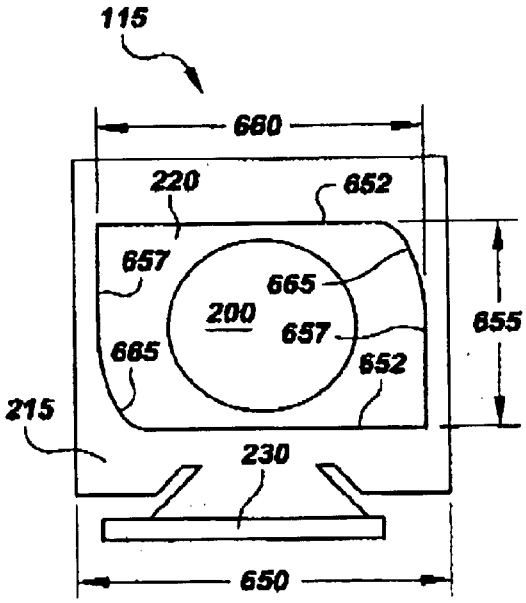
FIGS. 5A and 5B are, respectively, bottom and top views of the adapter of FIG. 2.
Figure 5B:
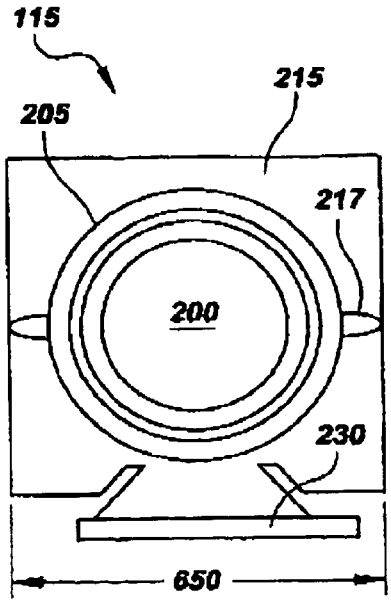

The first element 205 includes a first flange element 215 formed along a plane that is generally perpendicular to the axis 202 (as shown in FIGS. 4A and 4B). The second element 210 includes a second flange element 220 formed along a plane that also is generally perpendicular to the axis 202. The first flange element 215 is formed at a portion of the first element 205 that connects with the second element 210. The second flange element 220 is formed at an end of the second element 210. Each of the flange elements 215, 220 protrude from the adapter 115 and are used to position, attach, and retain the adapter 115 to the lighting track 105.

FIGS. 6A, 6B, 7A, and 7B illustrate attachment of the adapter 115 to the lighting track 105. To facilitate attachment and to secure the adapter 115 to the lighting track 105, the flange elements 215, 220 are designed to complement the various features of the lighting track 105. The lighting track 105 includes side walls 600, a portion 605 forming a trough 610, and ledges 615 extending into the trough 610 from the side walls 600. The side walls 600 of the lighting track 105 define an outer width 620 and an inner width 625. In addition, the ledges 615 are separated from each other by a distance 630.

The first flange element 215 has four sides, with each of the four sides spanning a width 650 (shown in FIGS. 5A and 5B) that is approximately greater than or equal to outer width 620 of the lighting track 105. Each of the four sides may be of substantially the same length. One side of the first flange element 215 forms a tab 230. The tab 230 may extend along a plane having a normal that is perpendicular to the normal of the first flange element 215. The tab 230 includes an angled side 235 connecting a long side 240 to a short side 245. The tab 230 is used to secure the adapter 115 to the lighting track 105, as discussed in more detail below.

The second flange element 220 also has four sides. Two sides 652 of the second flange element 220 span a width 655 that is less than the distance 630 separating the ledges 615. The other two sides 657 span a width 660 that is less than the inner width 625 but greater than the distance 630 separating the ledges 615. In this way, the adapter 115 may be inserted into the lighting track 105 by positioning the second flange element 220 such that the two sides 652 fit through the distance 630. At least one of the corners 665 of the second flange element 220 is rounded to facilitate rotation of the adapter 115 relative to the lighting track 105, as discussed in more detail below. Furthermore, the second element 210 has a width 670 that is less than the distance 630 separating the ledges 615 to facilitate insertion of the adapter 115 into the lighting track 105.

Referring also to FIGS. 8, 9A, 9B, 10A, and 10B, the lighting track 105 is installed to the ceiling structure 110 according to a procedure 800. First, the device 120 is connected to the ceiling structure (step 805). For example, in FIG. 1, the cable coupler 122 is mounted to the ceiling structure 110 by pulling or pushing the crimp 140 into the ceiling fitting 135 until secure, and then connecting the ceiling fitting 135 to a clip 130, which attaches to the ceiling structure 110.

Figure 9A:
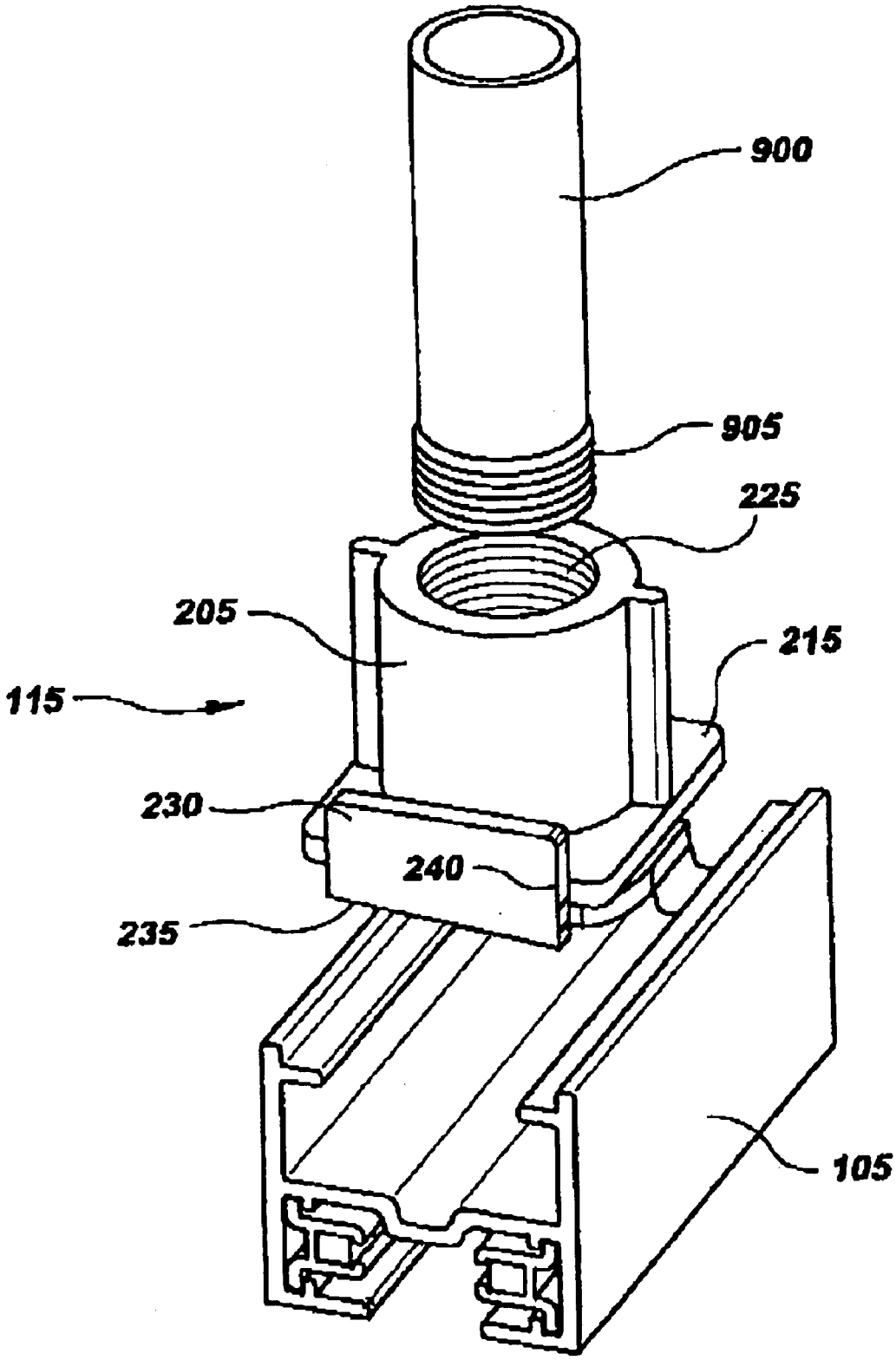
FIGS. 9A, 9B, 10A, and 10B are perspective views showing attachment of the device, adapter, and lighting track.
Figure 9B:
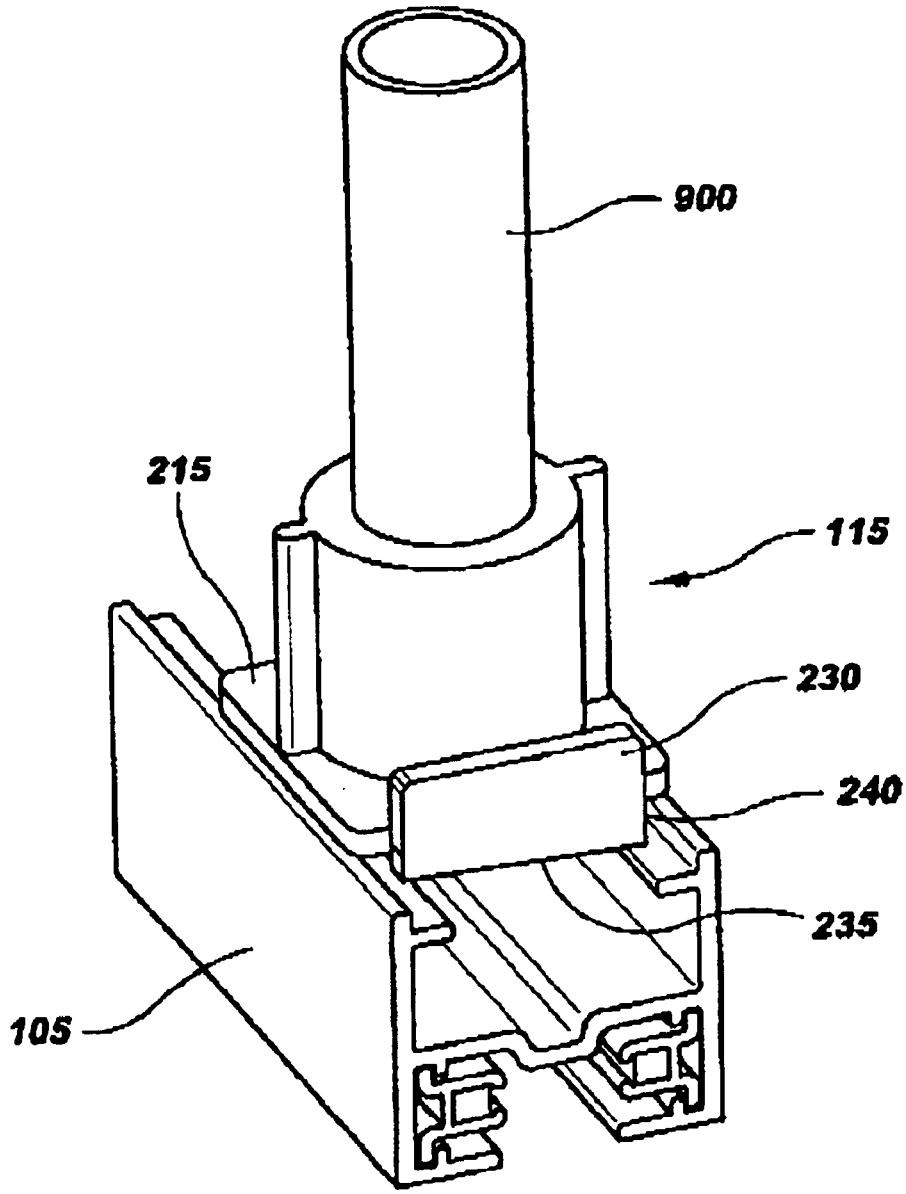
Figure 10A:
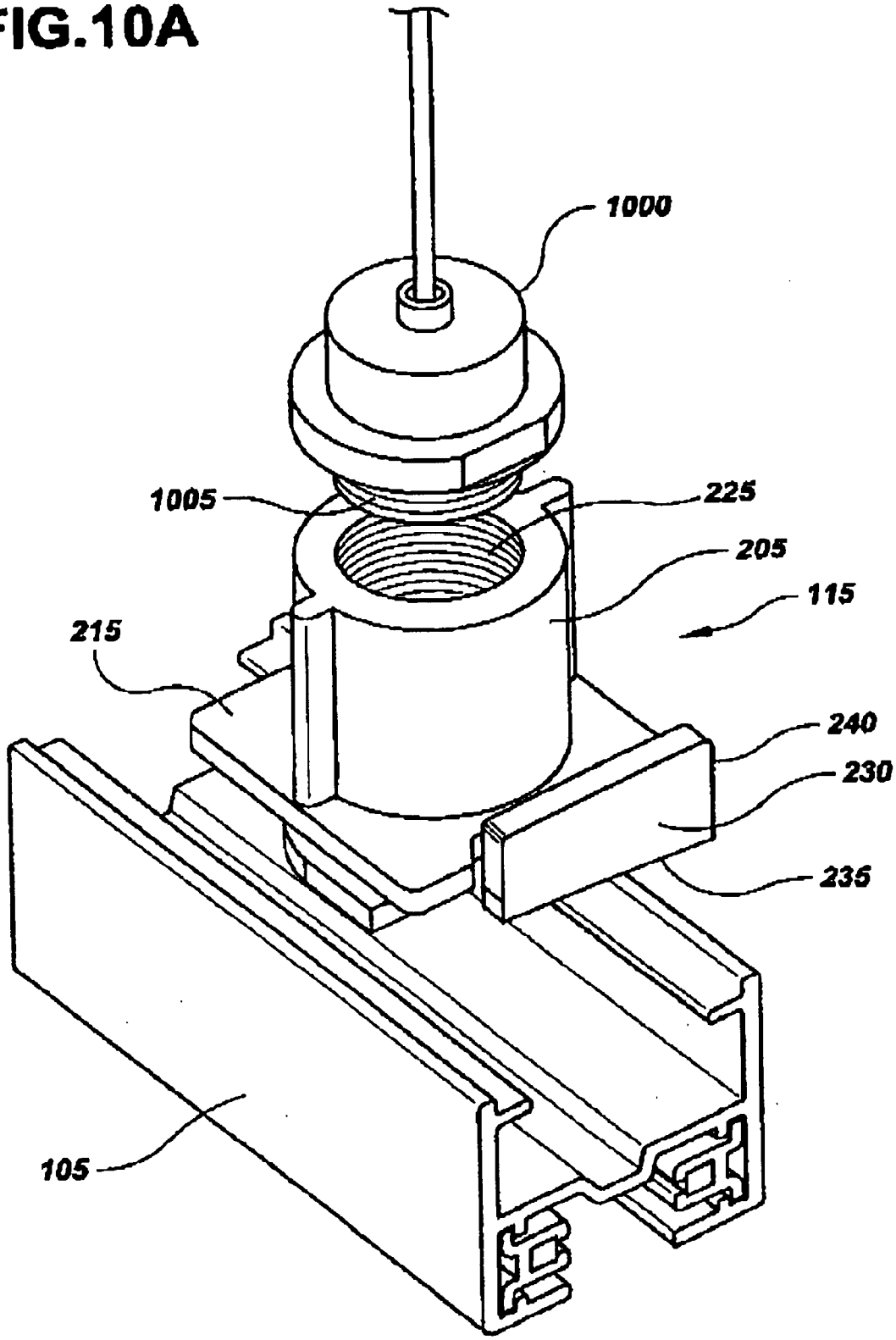
Figure 10B:
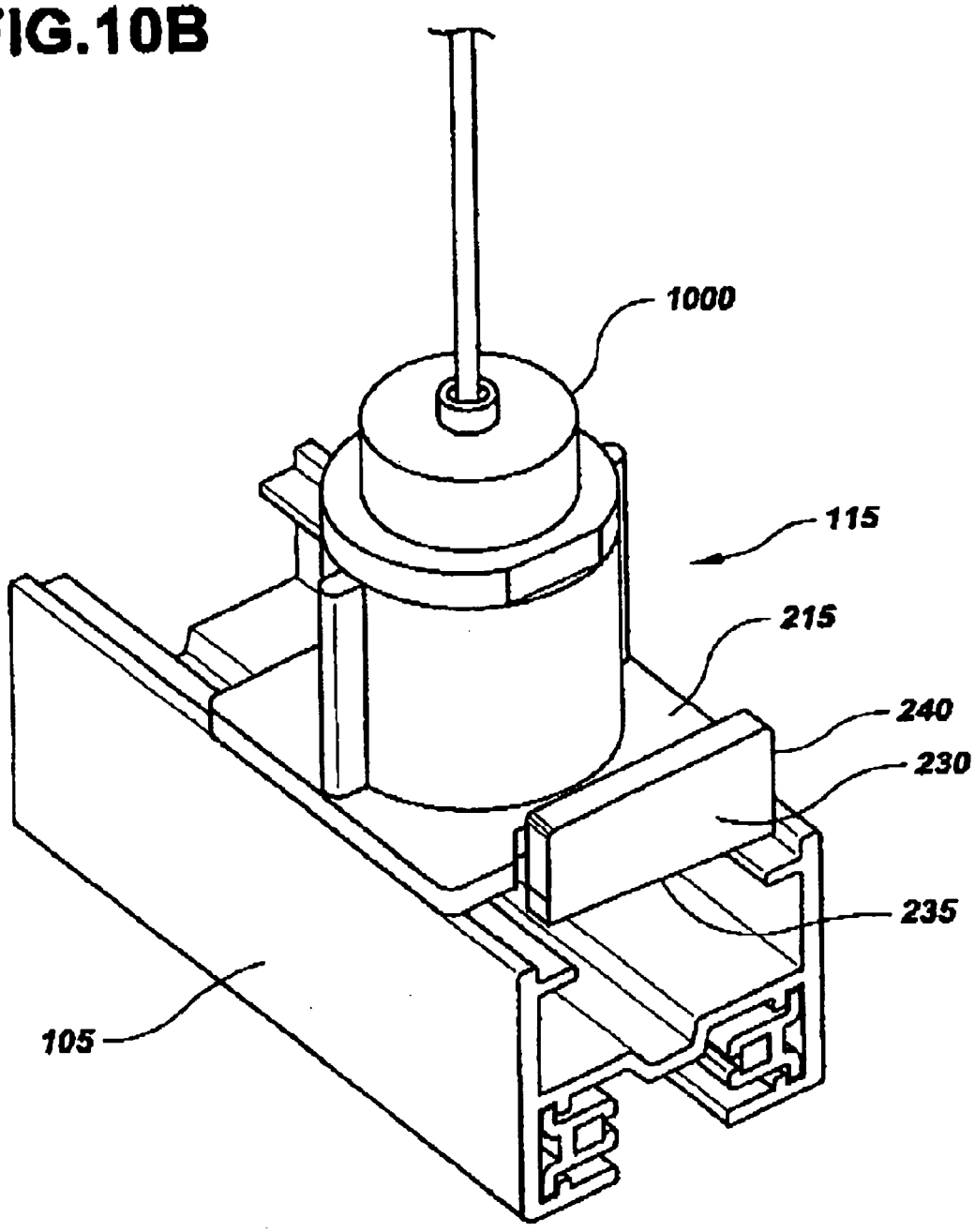

The device 120 is connected to the first element 205 of the adapter 115 (step 810). For example, as shown in FIGS. 9A and 9B, in one implementation, the device 120 includes a tube 900 that is screwed into the first element 205 using threads 905 that match threads along the inner surface 225 of the first element 205. In another example, as shown in FIGS. 10A and 10B, the device 120 includes a cable coupler 1000 that is screwed into the first element 205 using threads 1005 that match the threads formed along the inner surface 225.

Figure 6A:
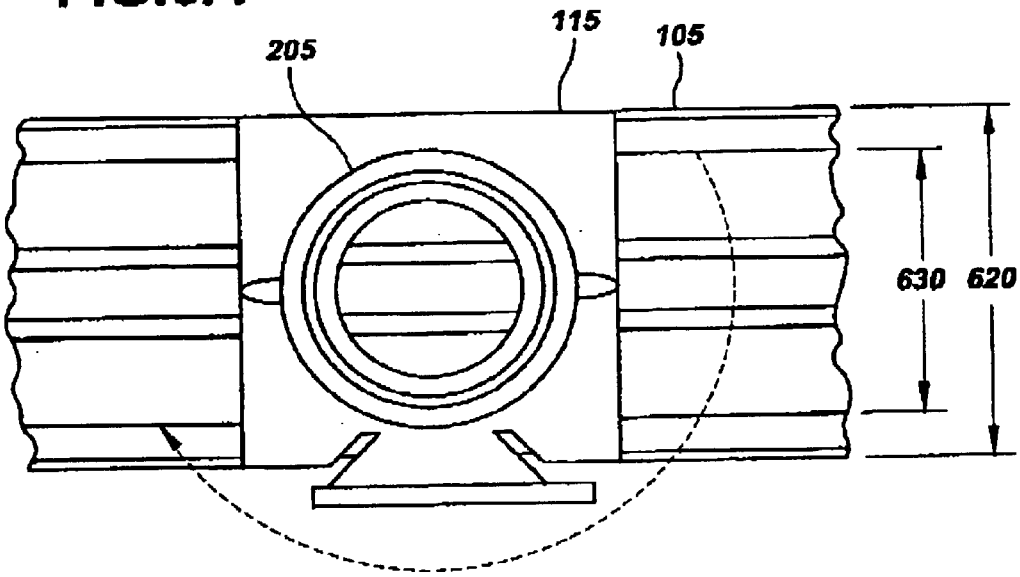
FIGS. 6A, 6B, 7A, and 7B are top and side views showing a procedure for attaching the adapter to the lighting track.
Figure 6B:
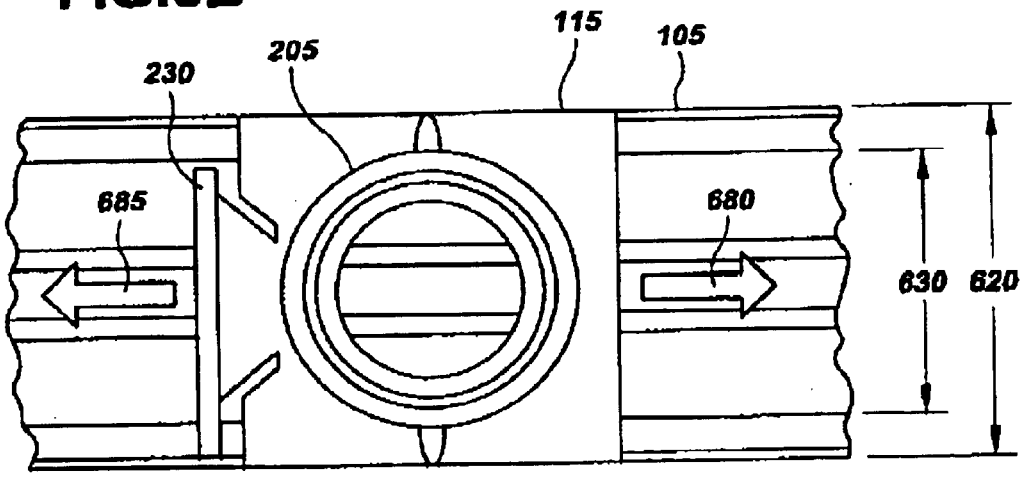
Figure 7A:
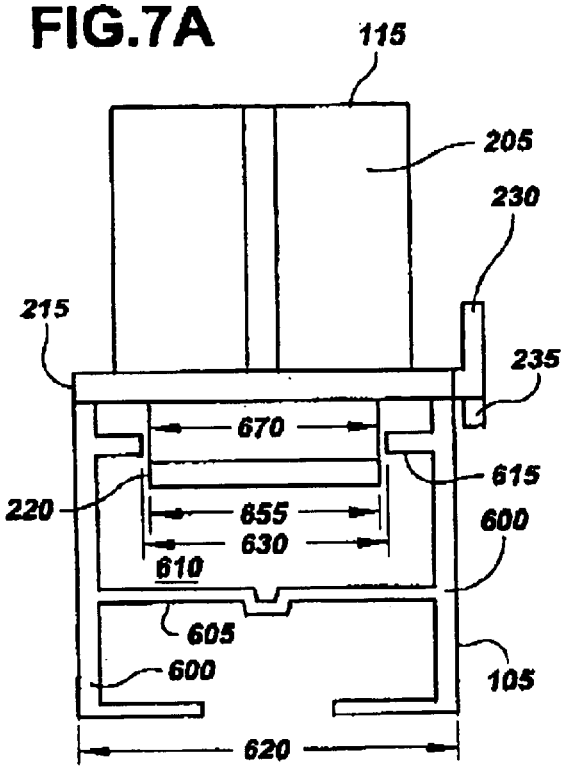
Figure 7B:
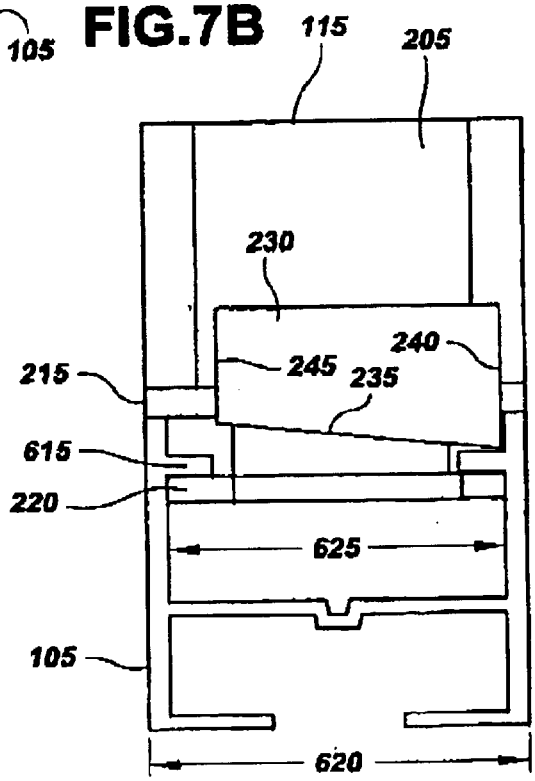
Figure 8:
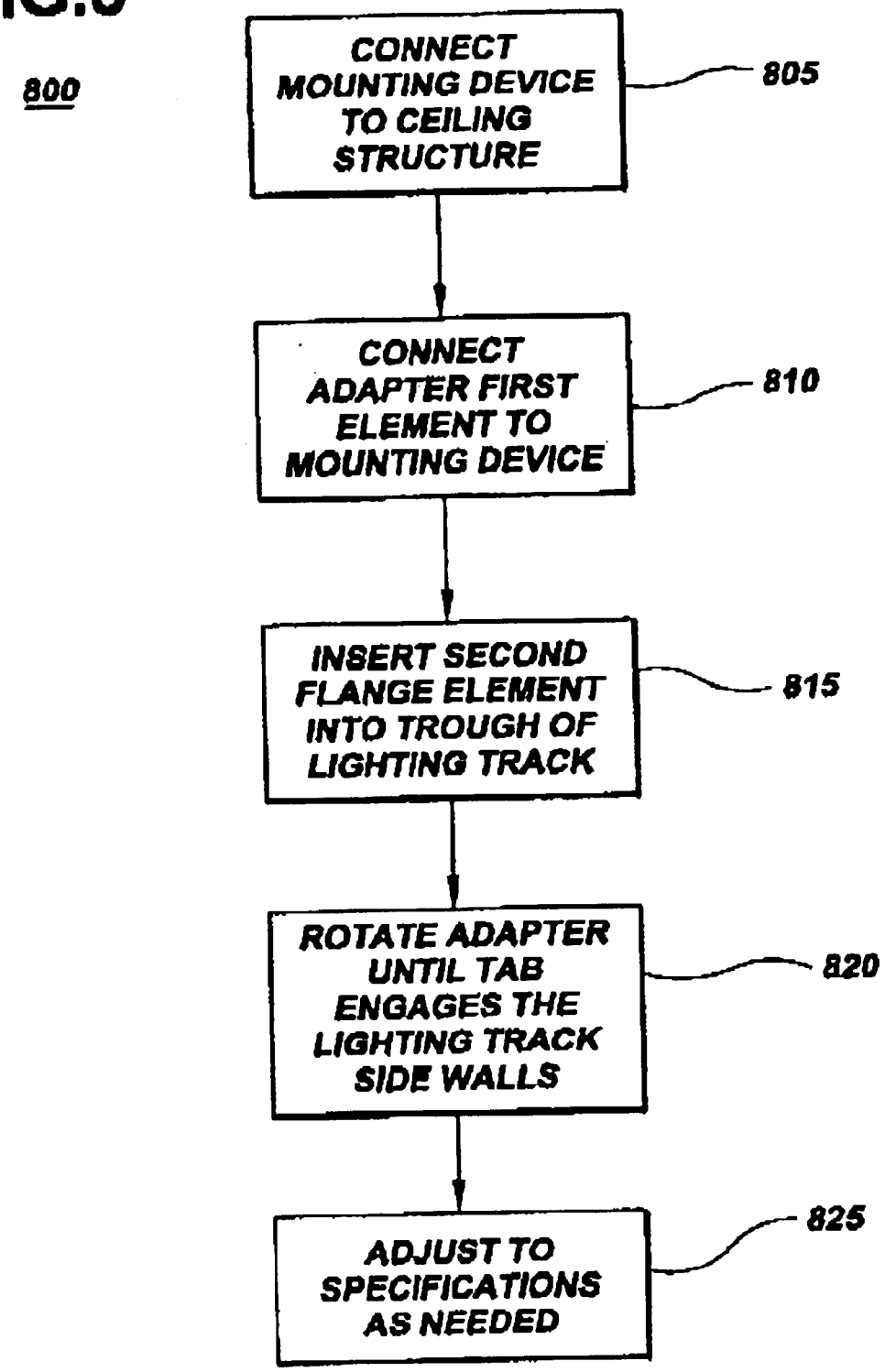
FIG. 8 is a flow chart of a procedure for attaching the adapter to the lighting track.

As shown in FIGS. 6A and 7A, the second flange element 220 is inserted into the lighting track 105 such that the sides 652 slide through the ledges 615 and into the trough 610 and the first flange element 215 rests on top of the side walls 600 (step 815).

As shown in FIGS. 6B, 7B, 9B, and 10B, the adapter 115 is rotated about the axis 202 until the adapter 115 snaps into place to no longer be rotatable about the axis 202 or translatable along the axis 202 relative to the lighting track 105 (step 820). In particular, as the adapter 115 is rotated, the side 235 engages the side walls 600, the corners 665 of the second flange element 220 slide across the inner surface of the side walls 600, and the second flange element 220 begins to engage the ledges 615. The more the adapter 115 is rotated, the greater the tension between the side 235 and the side walls 600 until the side 240 clears the side wall 600. At that point, the side 235 engages the ledge 615, the side 240 engages the side walls 600, and the second flange element 220 fully engages the ledges. In this way, the adapter 115 is prevented from rotating about the axis 202 and from moving along the axis 202 relative to the lighting track 105.

Once the adapter 115 snaps into place (step 820), the adapter may be translated along the longitudinal axis of the lighting track 105 (as shown by arrows 680, 685 in FIG. 6B) to facilitate further adjustment and installation. Upon completion of adjustment, the retaining device 170 may be cut to fit gaps along the lighting track 105 and then inserted into the lighting track to prevent movement of the adapter 115 along the longitudinal axis of the lighting track 105. At this point, the adapter 115, the lighting track 105, and the device 120 may be adjusted as necessary (step 825).

Other implementations are within the scope of the following claims. For example, the device may be attached to the adapter using other attachment mechanisms. To this end, the adapter may be designed to have threads along an outer surface that match threads along an inner surface of the device, or the adapter and the device may be designed to snap fit to each other. The adapter, and in particular, the first and second elements, may have a non-cylindrical shape, such as a polyhedral shape.

What is claimed is:

1. An adapter for connecting a lighting track to a ceiling structure, the lighting track having side walls, a bottom portion, and ledges, the side walls and bottom portion defining a trough, the ledges protruding into the trough, the adapter comprising:

a first element for attaching to a device that is secured to the ceiling structure, the first element being cylindrical along a longitudinal axis;

a first flange element, attached to the first element, for engaging at least one of the side walls of the lighting track and at least one of the ledges of the lighting track;

a second element attached to the first flange element, the second element receivable between the ledges of the lighting track; and a second flange element, attached to the second element, for engaging the ledges of the lighting track.

2. The adapter of claim 1 in which the device includes threads and the first element includes threads that match threads of the device to facilitate attachment of the first element to the device.

3. The adapter of claim 1 in which the first element includes an opening through which the device is secured.

4. The adapter of claim 1 in which the first element includes a ridge formed along an outer surface.

5. The adapter of claim 1 in which the first flange element is defined by a plane that is generally perpendicular to the longitudinal axis.

6. The adapter of claim 1 in which the first flange element includes a tab protruding from a side of the first flange element, the tab being defined by a plane that is generally parallel to the longitudinal axis, and having a long side, a short side, and an angled side joining the short side to the long side.

7. The adapter of claim 6 which the angled side engages at least one of the ledges and the long side engages at least one of the side walls of the lighting track when the adapter is attached to the lighting track.

8. The adapter of claim 7 in which the second flange element is receivable between the ledges of the lighting track.

9. The adapter of claim 8 in which the second flange element is defined by a plane that is generally perpendicular to the longitudinal axis.

10. The adapter of claim 9 in which the second flange element has four sides, two of which span a width less than a distance between the ledges of the lighting track and two of which span a width greater than the distance between the ledges of the lighting track.

11. An adapter for connecting a lighting track to a ceiling structure, the adapter comprising:

a first element for attaching to a device that is secured to the ceiling structure;

a first flange element attached to the first element and defined by a plane that is generally perpendicular to a longitudinal axis, the first flange element including a tab defined by a plane that is generally parallel to the longitudinal axis, the tab including:

a short side that extends along a direction parallel to the longitudinal axis;

a long side, extending parallel to the short side, for engaging one of a pair of side walls of the lighting track when the adapter is attached to the lighting track; and an angled side extending from the long side to the short side and engaging one of a pair of ledges protruding from the side walls of the lighting track when the adapter is attached to the lighting track;

a second element attached to the first flange element and receivable between the ledges of the lighting track; and a second flange element attached to the second element, the second flange element being defined by a plane having a normal parallel to the longitudinal axis.

12. A system for installing a lighting track to a ceiling structure, the system comprising:

a lighting track including side walls and ledges protruding inward from the side walls;

a device attached to the ceiling structure; and an adapter defining a longitudinal axis and including:

a first element that attaches to the device;

a first flange element attached to the first element;

a second element attached to the first flange element; and a second flange element attached to the second element;

in which the adapter is attached to the lighting track when the first flange element engages at least one of the side walls and at least one of the ledges of the lighting track, and second flange element engages the ledges.

13. The system of claim 12 in which the first element is cylindrical along the longitudinal axis.

14. The system of claim 12 in which the device includes threads and the first element includes threads that match threads of the device to facilitate attachment of the first element to the device.

15. The system of claim 12 in which the first element includes an opening through which the device is secured.

16. The system of claim 12 in which the first element includes a ridge formed along an outer surface.

17. The system of claim 12 in which the first flange element is defined by a plane that is generally perpendicular to the longitudinal axis.

18. The system of claim 12 which the first flange element includes a tab protruding from a side of the first flange element, the tab being defined by a plane that is generally parallel to the longitudinal axis, and having a long side, a short side, and an angled side joining the short side to the long side.

19. The system of claim 18 in which the angled side engages at least one of the ledges and the long side engages at least one of the side walls of the lighting track when the adapter is attached to the lighting track.

20. The system of claim 19 in which the second flange element is receivable between the ledges of the lighting track.

21. The system of claim 20 in which the second flange element is defined by a plane that is generally perpendicular to the longitudinal axis.

22. The system of claim 21 in which the second flange element has four sides, two of which span a width less than a distance between the ledges of the lighting track and two of which span a width greater than the distance between the ledges of the lighting track.

23. The system of claim 12 further comprising a retainer that attaches to the lighting track to prevent the adapter from moving along a longitudinal axis of the lighting track when the adapter is attached to the lighting track.

24. A method for installing a lighting track to a ceiling structure using an adapter, the method comprising:

providing a lighting track having side walls, a bottom portion forming a trough, and ledges extending into the trough from the side walls;

providing an adapter having a longitudinal axis and having a first element, a first flange element attached to the first element and having a tab element, a second element attached to the first flange element, and a second flange element attached to the second element;

connecting a device to the first element;

inserting the second flange element into the trough such that the second element lines up with the ledges and the first flange element engages the side walls;

rotating the adapter about the longitudinal axis such that the second flange element engages the ledges, and the tab element engages at least one of the ledges; and connecting the device to the ceiling structure.

25. The method of claim 24 in which rotating the adapter comprises rotating the adapter until the tab element engages at least one of the side walls.

26. The method of claim 24 in which rotating the adapter comprises rotating the adapter until the tab element is positioned between the side walls to prevent the adapter from rotating about the longitudinal axis relative to the lighting track.

27. The method of claim 24 in which rotating the adapter comprises rotating the adapter until the adapter is prevented from translating along the longitudinal axis relative to the lighting track.

28. The method of claim 24 in which inserting the second flange element into the trough includes inserting the second flange element beyond the ledges.

29. The method of claim 24 in which inserting the second flange element into the trough includes positioning the adapter such that the tab element is external to the trough.

30. The method of claim 24 in which rotating the adapter comprises rotating the adapter until the adapter may be translated along a longitudinal axis of the lighting track.

31. The method of claim 30 in which connecting the device to the ceiling structure comprises translating the adapter along the longitudinal axis of the lighting track.

32. The method of claim 30 further comprising connecting a retainer to the lighting track to prevent the adapter from moving along the longitudinal axis of the lighting track.

* * * * *